US005989173A

United States Patent [19]

Lugea et al.

[11] Patent Number: 5,989,173

[45] Date of Patent: Nov. 23, 1999

[54] MULTIFUNCTIONAL MANUAL FOLDING MACHINE

[76] Inventors: Jose MaLugea; Rosa María Garcia, both of Serapio Múgica, 15, 20302 Irun (Guipúzcoa), Spain

[21] Appl. No.: 08/898,950

[22] Filed: Jul. 23, 1997

[30] Foreign Application Priority Data

Jul. 24, 1996 [ES] Spain ..... 9602018 U

[51] Int. Cl.[6] ..... B31B 1/14

[52] U.S. Cl. ..... 493/356; 493/405

[58] Field of Search ..... 53/116, 117; 493/405, 493/356, 363, 372, 384, 385, 268, 417, 455; 370/37

[56] References Cited

U.S. PATENT DOCUMENTS 766,905 8/1904 Ruth ..... 493/356
1,082,812 12/1913 Kros ..... 493/356
1,124,375 1/1915 Wood ..... 493/385
1,346,109 7/1920 Astley ..... 493/405
4,421,500 12/1983 Smith ..... 493/405

*Primary Examiner*—John Sipos
*Assistant Examiner*—Steven Jensen
*Attorney, Agent, or Firm*—Bierman, Muserlian and Lucas

[57] ABSTRACT

The multifunctional manual folding machine of the present invention performs the functions of folding, hole punching, stapling, and letter opening. It is also equipped with an adhesive tape dispenser, a calculator, a digital clock and a calendar. The folding is accomplished by a handle that rotates about a triangular-shaped base. The handle matches the angles in the base to cause folds in the paper. The stapler and hole punch are operated by the handle also.

19 Claims, 3 Drawing Sheets

MULTIFUNCTIONAL MANUAL FOLDING MACHINE

This invention involves a multifunctional manual folding machine.

One of the most common office jobs is folding, e.g. folding correspondence for placement in envelopes.

Other common office jobs include punching holes in groups of sheets or documents for filing, stapling these sheets or documents and opening correspondence.

Currently, these functions are usually performed manually—in the case of folding correspondence—or require a different device for each specific task—in the case of punching or stapling.

SUMMARY OF THE INVENTION

This invention performs what were until now diverse functions with one single machine and offers other possibilities for use, and all this without requiring sophisticated mechanisms but rather by using a manually operated machine that does not require maintenance.

The multifunctional manual folding machine, according to the invention, is characterized by the fact that it basically consists of the following:

a) a main body, defined by a stop-support from which three successive surfaces at angles to each other project:

b) a folding head with handle, articulated to this main body and provided with sharp edges, positionally conjugated in the catch with the edges that delimit each pair of successively angular surfaces;

in such a way that, in the extreme open position of the folding head, a box is delimited between the head, the stop-support and the main body which admits the sheet(s), which is(are) folded by manually tilting the folding head and leaning it(them) against the angular surfaces.

This main body is internally counterweighted to provide stability to the assembly.

This device folds one or more sheets simply by lifting its head and placing the sheet(s) in the slot that is formed. Once inserted, the head is lowered (it is provided with a handle for this reason) all the way down and the sheets will be folded or impressed along two lines, thus being divided into three equal parts.

It offers multiple additional functions, such as a punch, a stapler with a receptacle for refills (hidden inside), and also a roll of adhesive paper with cutter, staple remover and letter opener; the head can have a digital clock with alarm and a calculating machine, and a space is left for promotional purposes, a calendar or other uses where publicity motifs can be inserted (user's name, logotype, etc.).

As an optional complement, an adjustable container is added with the same shape as the device, with several compartments for holding, for example, pens, pencils, scissors, etc., with built-in sharpener and a drawer for collecting the waste resulting from this operation, as well as a pencil lead sharpener. On one of the sides, a block of adhesive paper can be placed, a roll of paper for notes.

It does not require maintenance, except for consumable parts.

In the event that any piece breaks (practically impossible if properly used, since the assembly is made of rigid plastic and all rotating and friction pieces are metal), it is easy to replace, since the device can be totally disassembled by manually loosening of two screws.

DETAILED DESCRIPTION OF THE INVENTION

Figure 1:
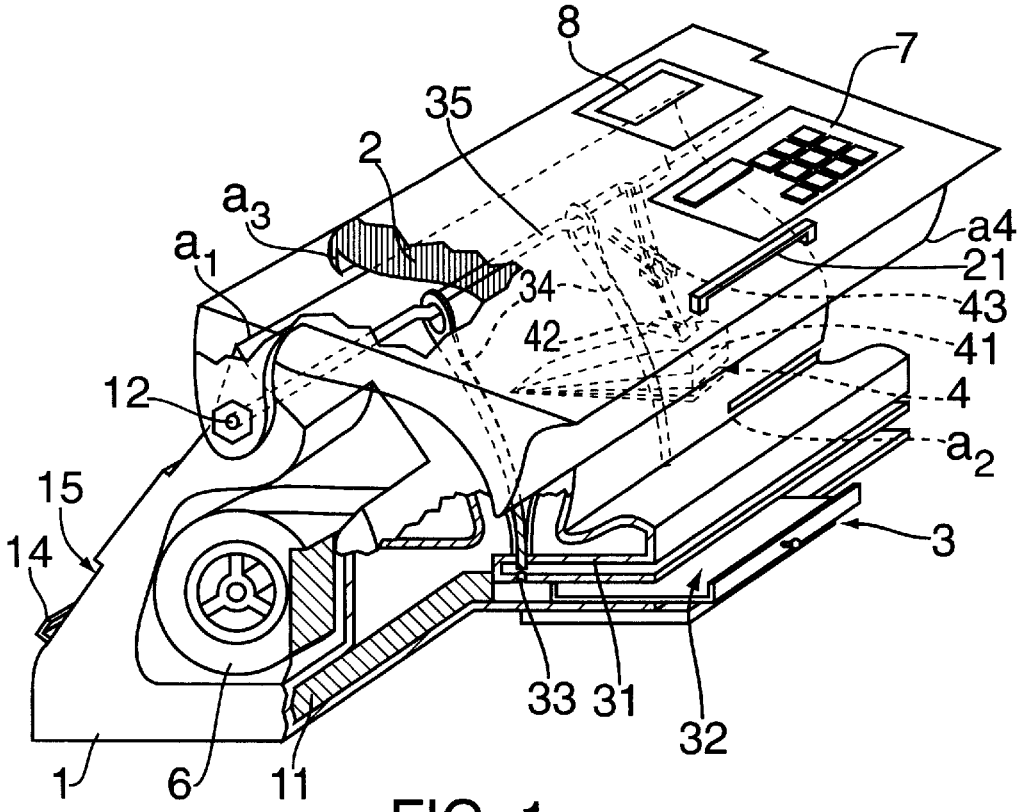
FIG. 1 shows a diagrammatic perspective of the assembly with two partial sections.

As shown in FIG. 1, the multifunctional manual folding machine is basically structured around a main body (1) and a folding head (2), which is articulated about axis (12).

The main body (1) is internally counterbalanced with a counterweight (11) that is hidden from view and provides stability to the assembly.

The main body (1) defines three successive surfaces ($13_a$), ($13_b$), ($13_c$), at an angle to each other. The surfaces are joined at an edge ($a_1$), ($a_2$) as shown in FIGS. 1 and 2.

Figure 5:
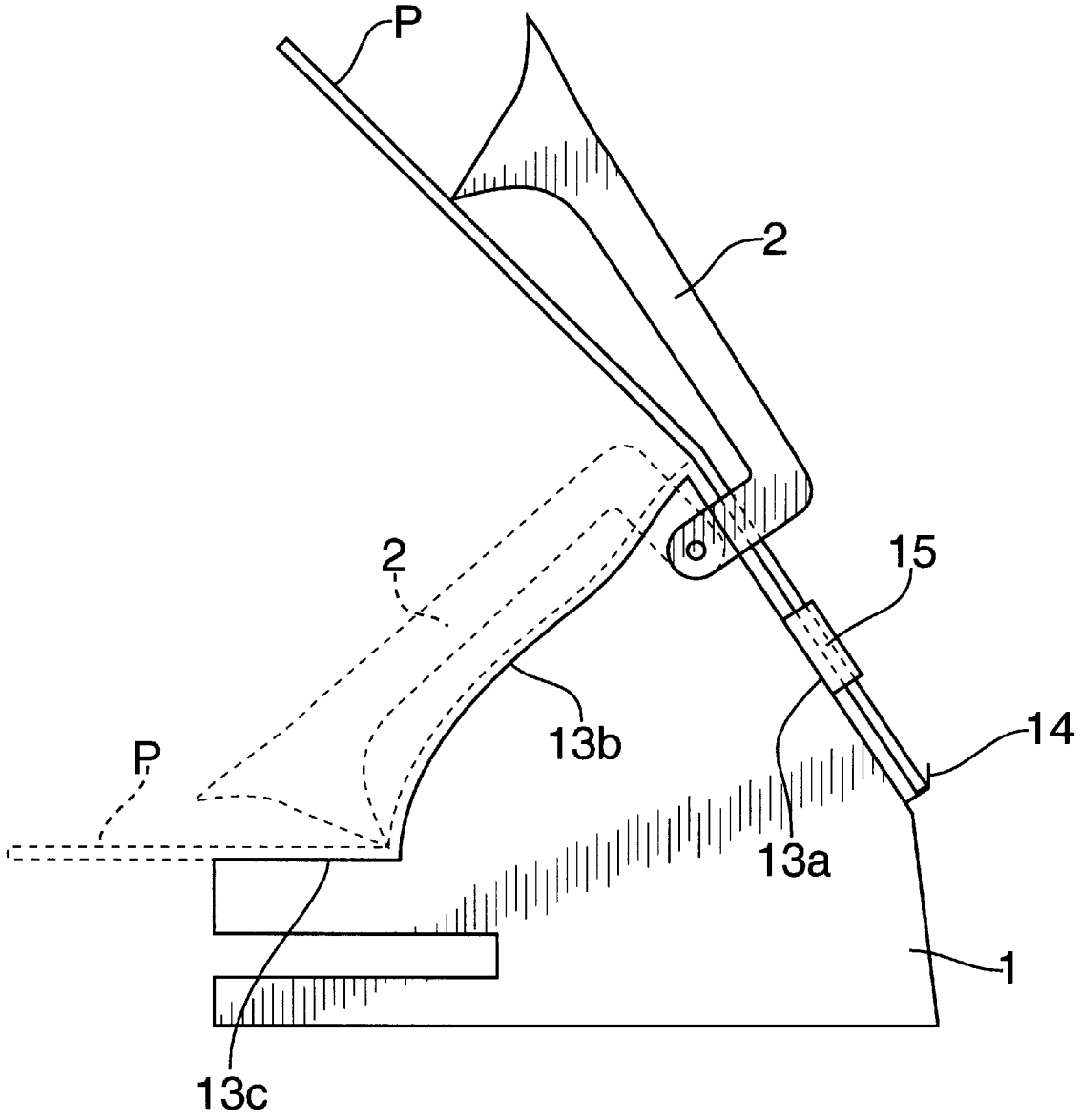
FIG. 5 is a left side view of the machine and shows the articulation of the head folding a sheet of paper (P).

A stop-support (14) is located on the first of these surfaces ($13_a$). A box (15) mounted on surface $13_a$ holds the sheet(s) and, as shown in FIG. 5, folded. The sheets are folded by manually tilting the head (2) such that head (2) comes together with base (1).

The folding head (2) is provided with a handle (21) for manipulation—contains, for the purposes described above, sharp edges ($a_3$), ($a_4$) which mate with the edges ($a_1$), ($a_2$) of the main body (1), to help fold the sheets.

Figure 2:
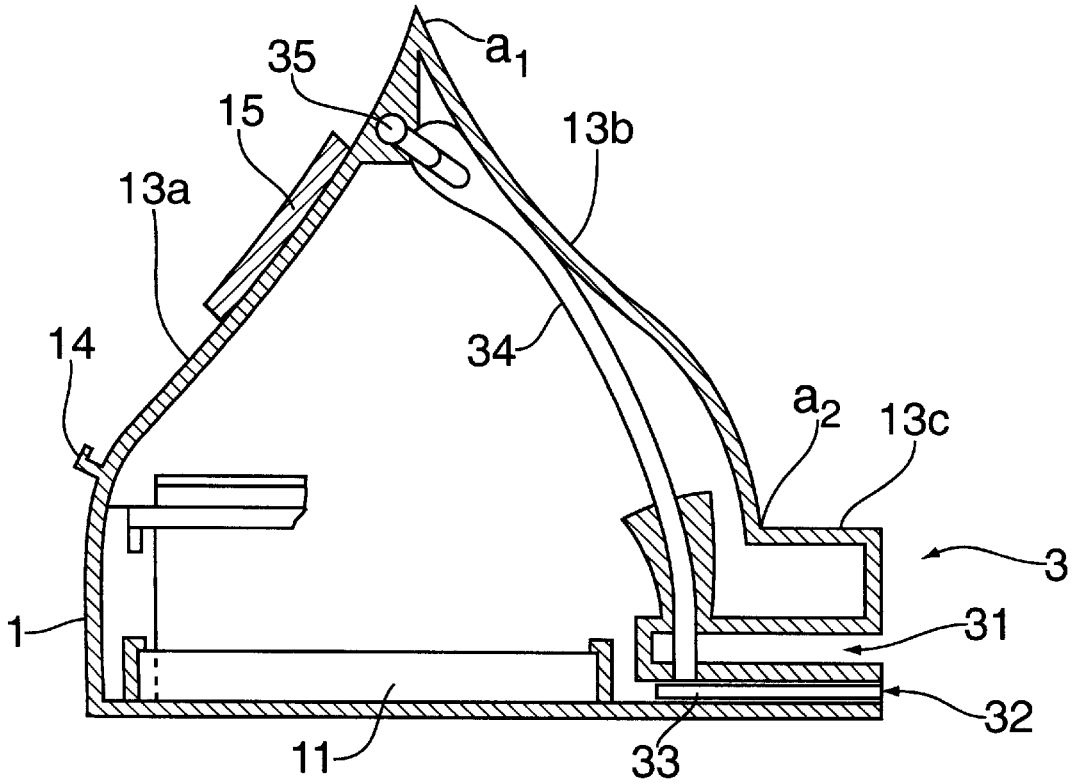
FIG. 2 shows a diagrammatic section in profile of the multifunctional manual folding machine, in order to illustrate the components of the punch (3) and its operating arrangement.

As shown in FIGS. 1 and 2 the punch (3) is formed in the main body (1) and comprises a front box (31) a lower drawer (32)and punch rods (34). The front box (31) has feedthrough openings (33) which are the guides for the punching rods (34).

The punching rods (34) are mounted on an eccentric axis (35) in correlation to the axis (12) of the head (2), in such a way that on manually tilting the head, holes are punched in the sheets, when the sheets are housed in the box (31).

Figure 3:
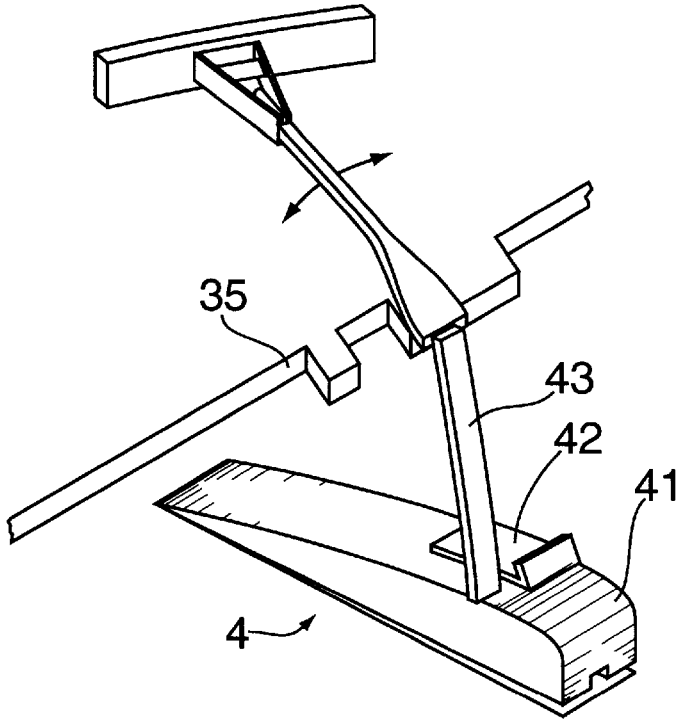
FIG. 3 shows a diagram of the pusher (43) retracted from the stapler (4)-non-operating position.

As shown in FIGS. 1 and 3, the stapler (4) is mounted in the main body (1). Its jaw or upper arm (41) has a base (42) in which a pusher (43) can be housed or from which it can be freed at will.

The pusher (43) is mounted on the eccentric axis (35) in correlation to the articulation axis (12) of the head (2), in such a way that when the head is manually tilted, the sheets are stapled when the sheets have been inserted in the stapler (4).

Figure 4:
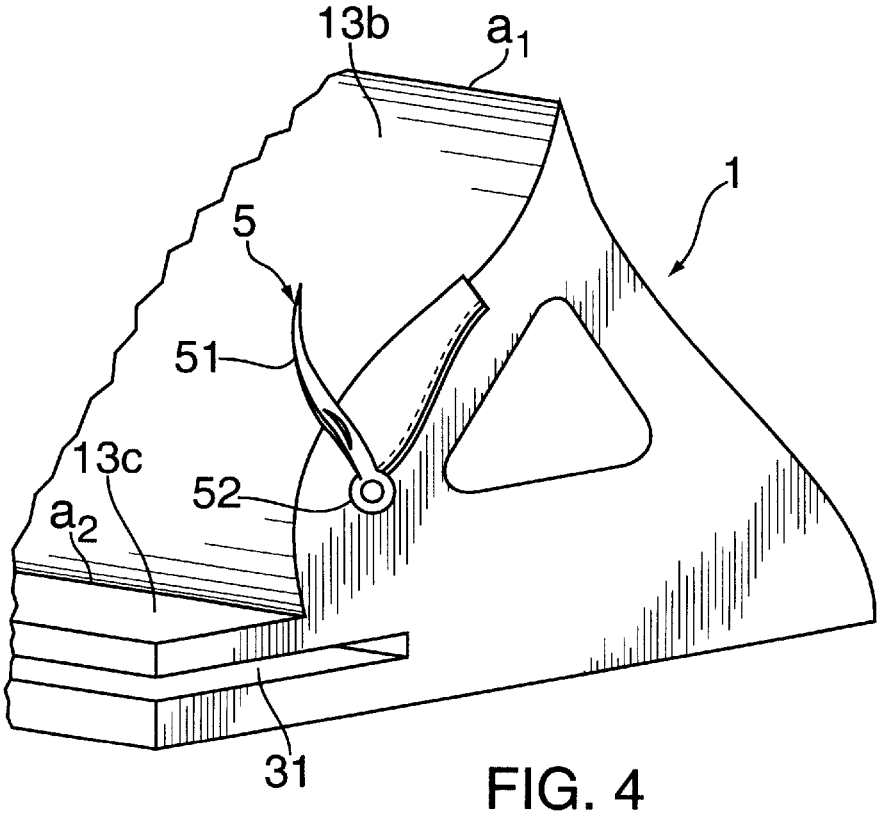
FIG. 4 shows a diagram of the letter opening knife (5) in operating position.

As shown in FIG. 4, the letter opener (5) is mounted on one of the sides of the main body (1) and its structure is a elongated knife (51) articulated on an axis (52) that can be tilted between two positions, one for using and one folding up, respectively.

Additional elements provide greater versatility to the folding machine covered by the invention without essentially altering the basic conception, and therefore they should be considered as included within the invention's scope.

For example, these additional elements could include, but are not limited to, the following (although they can be replaced by others, or further elements can be added, without altering the basic concept of the Model):

a) an adhesive tape roll holder support (6), mounted on one of the sides of the main body (1)—opposite the side holding the letter opener (5);

b) a calculating machine (7) and/or a calendar (8), with or without built-in digital clock, on the folding head (2);

c) other components such as pencil holder, sharpener and/or pencil lead sharpener, preferably attached to the main body (1).

As can be seen in FIGS. 1 and 2, stapler (4) with its respective pusher (43) and punching rod (34) are hidden within base (1).

As can be seen from FIGS. 1 and 2, punch (3) comprises a front box and a lower drawer, where the front box contains transversal feedthrough openings that are the guide for the punching rods mounted eccentrically on the axis. The punching rods are mounted on the axis in such a way that on manually tilting the head, the sheets placed in the front box are punched and the waste is deposited in the aforesaid lower drawer.

Also, as can be seen in FIGS. 1 and 3, the stapler is also mounted in the main body and is equipped with a pusher that is eccentrically mounted on the axis. This pusher can be connected to or freed from the stapler base, in such a way that manually tilting the head may or may not actuate the stapler depending on the relative position of the pusher and base.

We claim:

1. A multifunctional manual folding machine comprising:

(a) a main body, said main body having a horizontal base, a first side extending upward from said base and forming an acute angle with a second side which extends downward from said acute angle and forming a right angle with a third side which extends horizontally outward from said second side and connects downwardly to said base;

(b) a stop support mounted on said first side;

(c) a box mounted on said first side for holding a sheet which is to be folded; and (d) a folding head rotatably attached by means of an axis to said main body, said folding head rotatable about said acute angle of said main body, said folding head having an open position and a closed position, said folding head having two angled surfaces, a first angled surface which mates with said first and second side at said acute angle when said folding head is in said closed position and a second angled surface which mates with said second and third side at said right angle when said folding head is in said closed position, wherein when said folding head is in said open position a sheet can be positioned between said folding head and said main body such that an edge of said sheet abuts said stop support and is held in said box, and said sheet is folded at two spots, at said acute angle and said right angle when said folding head is moved to said closed position.

2. The machine of claim 1 further comprising:

a hole punch device, said hole punch device comprising:

a front box and a lower drawer wherein a portion of the top of said box forms said third side;

said box and said drawer having holes which are aligned with each other; and punch rods which at one end are aligned with said holes and at the other end are eccentrically connected to said axis, such that when said folding head is in said open position the punch rods rise up allowing a sheet to be placed between the holes in the box and the drawer and when said folding head is moved to said closed position, said punch rods punch holes in said sheet and waste sheet from said holes falls into said drawer.

3. The machine of claim 1 further comprising:

a stapler, said stapler comprising:

a pair of opposing jaws mounted in said main body; and a pusher rod connected at one end to said stapler and at the other end eccentrically connected to said axis, such that when said folding head is in said open position the pusher rod is up and the jaws of the stapler are open allowing sheets to be placed between the jaws of the stapler and when said folding head is moved to said closed position, said pusher rod causes said jaws to close and a stapler to be affixed to said sheets.

4. The machine of claim 1 further comprising a letter opener, said letter opener comprising a knife which is rotatably mounted on said main body, said knife rotatable between a first position where said knife extends upward and can be used for opening letters and a second position where said knife is folded away.

5. The machine of claim 1 further comprising a counterweight mounted in said base of said main body to provide stability to said machine.

6. The machine of claim 1 further comprising an adhesive tape holder, said holder mounted in said main body.

7. The machine of claim 1 further comprising a calculating machine mounted on said folding head.

8. The machine of claim 1 further comprising a digital clock mounted on said folding head.

9. The machine of claim 1 further comprising a calendar mounted on said folding head.

10. A multifunctional manual folding machine comprising:

(a) a main body, said main body having a horizontal base, a first side extending upward from said base and forming an acute angle with a second side which extends downward from said acute angle and forming a right angle with a third side which extends horizontally outward from said second side and connects downwardly to said base;

(b) a stop support mounted on said first side;

(c) a box mounted on said first side for holding a sheet which is to be folded;

(d) a folding head rotatably attached by means of an axis to said main body, said folding head rotatable about said acute angle of said main body, said folding head having an open position and a closed position, said folding head having two angled surfaces, a first angled surface which mates with said first and second side at said acute angle when said folding head is in said closed position and a second angled surface which mates with said second and third side at said right angle when said folding head is in said closed position, wherein when said folding head is in said open position a sheet can be positioned between said folding head and said main body such that an edge of said sheet abuts said stop support and is held in said box, and said sheet is folded at two spots, at said acute angle and said right angle when said folding head is moved to said closed position;

(e) a hole punch device, said hold punch device comprising (e1) a front box and a lower drawer wherein a portion of the top of said box forms said third side;

(e2) said box and said drawer having holes which are aligned with each other; and (e3) punch rods which at one end are aligned with said holes and at the other end are eccentrically connected to said axis, such that when said folding head is in said open position the punch rods rise up allowing a sheet to be placed between the holes in the box and the drawer and when said folding head is moved to said closed position, said punch rods punch holes in said sheet and waste sheet from said holes falls into said drawer.

11. The machine of claim 10 further comprising a stapler, said stapler comprising:

a pair of opposing jaws mounted in said main body; and a pusher rod connected at one end to said stapler and at the other end eccentrically connected to said axis, such that when said folding head is in said open position the pusher rod is up and the jaws of the stapler are open allowing sheets to be placed between the jaws of the stapler and when said folding head is moved to said closed position, said pusher rod causes said jaws to close and a stapler to be affixed to said sheets.

12. The machine of claim 10 further comprising a letter opener, said letter opener comprising a knife which is rotatably mounted on said main body, said knife rotatable between a first position where said knife extends upward and can be used for opening letters and a second position where said knife is folded away.

13. The machine of claim 10 further comprising a counterweight mounted in said base of said main body to provide stability to said machine.

14. The machine of claim 10 further comprising an adhesive tape holder, said holder mounted in said main body.

15. The machine of claim 10 further comprising a calculating machine mounted on said folding head.

16. The machine of claim 10 further comprising a digital clock mounted on said folding head.

17. The machine of claim 10 further comprising a calendar mounted on said folding head.

18. A multifunctional manual folding machine comprising:

(a) a main body, said main body having a horizontal base, a first side extending upward from said base and forming an acute angle with a second side which extends downward from said acute angle and forming a right angle with a third side which extends horizontally outward from said second side and connects downwardly to said base;

(b) a stop support mounted on said first side;

(c) a box mounted on said first side for holding a sheet which is to be folded;

(d) a folding head rotatably attached by means of an axis to said main body, said folding head rotatable about said acute angle of said main body, said folding head having an open position and a closed position, said folding head having two angled surfaces, a first angled surface which mates with said first and second side at said acute angle when said folding head is in said closed position and a second angled surface which mates with said second and third side at said right angle when said folding head is in said closed position, wherein when said folding head is in said open position a sheet can be positioned between said folding head and said main body such that an edge of said sheet abuts said stop support and is held in said box, and said sheet is folded at two spots, at said acute angle and said right angle when said folding head is moved to said closed position;

(e) a hole punch device, said hold punch device comprising (e1) a front box and a lower drawer wherein a portion of the top of said box forms said third side;

(e2) said box and said drawer having holes which are aligned with each other;

(e3) punch rods which at one end are aligned with said holes and at the other end are eccentrically connected to said axis, such that when said folding head is in said open position the punch rods rise up allowing a sheet to be placed between the holes in the box and the drawer and when said folding head is moved to said closed position, said punch rods punch holes in said sheet and waste sheet from said holes falls into said drawer;

(f) a stapler, said stapler comprising:

(f1) a pair of opposing jaws mounted in said main body; and (f2) a pusher rod connected at one end to said stapler and at the other end to eccentrically connected to said axis, such that when said folding head is in said open position the pusher rod is up and the jaws of the stapler are open allowing sheets to be placed between the jaws of the stapler and when said folding head is moved to said closed position, said pusher rod causes said jaws to close and a stapler to be affixed to said sheets;

(g) a letter opener, said letter opening comprising a knife which is rotatably mounted on said main body, said knife rotatable between a first position where said knife extends upward and can be used for opening letters and a second position where said knife is folded away;

(h) a counterweight mounted in said base of said main body to provide stability to said machine; and (i) an adhesive tape holder, said holder mounted in said main body.

19. The machine of claim 18 further comprising:

a calculating machine mounted on said folding head;

a digital clock mounted on said folding head; and a calendar mounted on said folding head.

* * * * *